US010611563B2

(12) United States Patent
Cobler et al.

(10) Patent No.: US 10,611,563 B2
(45) **Date of Patent: *Apr. 7, 2020**

(54) POLYMERIC BAGS

(71) Applicant: Poly-America, L.P., Grand Prairie, TX (US)

(72) Inventors: Brad A. Cobler, Irving, TX (US); Anthony H Bertrand, Mansfield, TX (US)

(73) Assignee: Poly-America, L.P., Grand Prairie, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/176,148

(22) Filed: Oct. 31, 2018

(65) Prior Publication Data

US 2019/0062045 A1 Feb. 28, 2019

Related U.S. Application Data

(63) Continuation of application No. 15/139,480, filed on Apr. 27, 2016, now Pat. No. 10,138,054, which is a continuation-in-part of application No. 14/659,785, filed on Mar. 17, 2015, now Pat. No. 9,487,334.

(51) Int. Cl.
*B65F 1/00* (2006.01)

(52) U.S. Cl.
CPC ..... *B65F 1/0006* (2013.01); *B65F 1/002* (2013.01)

(58) Field of Classification Search
CPC ..... B65F 1/0006; B65F 1/002
USPC ..... 383/105, 77, 118
See application file for complete search history.

(56) References Cited

U.S. PATENT DOCUMENTS 5,028,289 A * 7/1991 Rasmussen ..... B29C 55/023 156/229
5,205,650 A * 4/1993 Rasmussen ..... B29C 55/18 383/107
8,865,294 B2 * 10/2014 Cisek ..... B32B 3/30 428/195.1
10,138,054 B2 * 11/2018 Cobler ..... B65F 1/0006
2005/0178493 A1 * 8/2005 Broering ..... B31B 50/00 156/197
2008/0187254 A1 * 8/2008 Hall ..... B65D 33/002 383/77
2009/0233041 A1 * 9/2009 Rasmussen ..... B29C 55/18 428/101
2010/0098354 A1 * 4/2010 Fraser ..... B65D 33/00 383/72
2011/0222797 A1 * 9/2011 Maxwell ..... B29C 53/24 383/75

(Continued)

*Primary Examiner* — Jes F Pascua
(74) *Attorney, Agent, or Firm* — Daniel J. Layden; Brandon J. Lee

(57) ABSTRACT

The present invention relates to improvements for the manufacturing of a wave-cut bag, more specifically a wave-cut bag with improved tie-flaps. Disclosed is a process for intermittently incrementally stretching and imparting a rib-like pattern to a collapsed tube of a blown film extrusion process. The incrementally stretched collapsed tube is particularly well suited for constructing wave-cut trash bags with a rib pattern on the tie-flaps of the trash bags. Further disclosed is a wave-cut trash bag with a rib pattern on its tie-flaps and surrounding area. The process is further well suited for constructing wave-cut trash bags with a rib pattern on a central body of the trash bags.

20 Claims, 14 Drawing Sheets

(56) References Cited

U.S. PATENT DOCUMENTS

| | | | | |
|---|---|---|---|---|
| 2011/0317945 | A1* | 12/2011 | Waldron | B29C 53/24 383/119 |
| 2012/0039550 | A1* | 2/2012 | MacPherson | B32B 7/14 383/109 |
| 2012/0064271 | A1* | 3/2012 | Broering | B32B 27/08 428/35.7 |
| 2012/0163738 | A1* | 6/2012 | Borchardt | B32B 27/36 383/107 |
| 2012/0269465 | A1* | 10/2012 | Dorsey | B29C 55/06 383/105 |
| 2012/0269466 | A1* | 10/2012 | Dorsey | B65D 31/02 383/109 |
| 2013/0259408 | A1* | 10/2013 | Borchardt | B32B 3/30 383/119 |
| 2014/0334749 | A1* | 11/2014 | Borchardt | B65D 33/00 383/109 |
| 2014/0378286 | A1* | 12/2014 | Borchardt | B30B 11/18 493/189 |
| 2015/0030266 | A1* | 1/2015 | Borchardt | B65D 33/00 383/109 |
| 2016/0264301 | A1* | 9/2016 | Cobler | B65D 31/02 |
| 2016/0272375 | A1* | 9/2016 | Cobler | B65D 33/1608 |
| 2017/0113872 | A1* | 4/2017 | Cobler | B65F 1/0006 |

* cited by examiner

POLYMERIC BAGS

CROSS-REFERENCE TO RELATED APPLICATIONS

This application is a continuation of application Ser. No. 15/139,480, filed Apr. 27, 2016, which is a continuation-in-part of application Ser. No. 14/659,785, filed Mar. 17, 2015. Both of these aforementioned applications are hereby incorporated by reference into this disclosure.

BACKGROUND OF THE INVENTION

1. Field of the Invention

The present invention relates to improvements in bags made from polymeric film and processes for manufacturing polymeric film bags.

2. Description of the Related Art

Thermoplastic films are used in a variety of applications. For example, thermoplastic films are used in sheet form for applications such as drop cloths, vapor barriers, and protective covers. Thermoplastic films can also be converted into plastic bags, which may be used in a myriad of applications. The present invention is particularly useful to trash bags constructed from thermoplastic film.

Polymeric bags are ubiquitous in modern society and are available in countless combinations of varying capacities, thicknesses, dimensions, and colors. The bags are available for numerous applications including typical consumer applications such as long-term storage, food storage, and trash collection. Like many other consumer products, increased demand and new technology have driven innovations in polymeric bags improving the utility and performance of such bags. The present invention is an innovation of particular relevance to polymeric bags used for trash collection and more particular for larger bags used for the collection of larger debris.

Polymeric bags are manufactured from polymeric film produced using one of several manufacturing techniques well-known in the art. The two most common methods for manufacture of polymeric films are blown-film extrusion and cast-film extrusion. In blown-film extrusion, the resulting film is tubular while cast-film extrusion produces a generally planar film. The present invention is generally applicable to drawstring trash bags manufactured from a blown-film extrusion process resulting in tubular film stock. Manufacturing methods for the production of drawstring bags from a collapsed tube of material are shown in numerous prior art references including, but not limited to, U.S. Pat. Nos. 3,196,757 and 4,624,654, which are hereby incorporated by reference.

In blown film extrusion, polymeric resin is fed into an extruder where an extrusion screw pushes the resin through the extruder. The extrusion screw compresses the resin, heating the resin into a molten state under high pressure. The molten, pressurized resin is fed through a blown film extrusion die having an annular opening. As the molten material is pushed into and through the extrusion die, a polymeric film tube emerges from the outlet of the extrusion die.

The polymeric film tube is blown or expanded to a larger diameter by providing a volume of air within the interior of the polymeric film tube. The combination of the volume of air and the polymeric film tube is commonly referred to as a bubble between the extrusion die and a set of nip rollers.

As the polymeric film tube cools travelling upward toward the nip rollers, the polymeric film tube solidifies from a molten state to a solid state after it expands to its final diameter and thickness. Once the polymeric film tube is completely solidified, it passes through the set of nip rollers and is collapsed into a collapsed polymeric tube, also referred to as a collapsed bubble.

One common method of manufacturing trash bags involves segregating the collapsed polymeric tube into individual trash bags by forming seals which extend transversely across the entire width of the tube. Typically, a line of perforations is formed immediately adjacent and parallel to each seal to facilitate separation of the trash bags one from another. After the trash bags are sealed and perforated, the trash bags can be twice-folded axially into a fractional width configuration.

It is also known to provide wave-cut trash bags. A wave-cut trash bag has a wave or lobe-shaped configuration at its open end. This provides two or more lobes, which can be used to tie the trash bag in a closed configuration after it is filled with refuse.

Wave-cut trash bags can be manufactured by providing closely spaced, parallel transversely extending seals at predetermined intervals along the collapsed polymeric tube. A transversely extending line of perforations is provided between the closely spaced, parallel seals. The collapsed polymeric tube is then separated longitudinally along a wave or lobe-shaped line located equidistant between the edges of the tube.

The lobe-shaped features, or lobes, of a wave-cut trash bags, which may also be referred to as tie-flaps, provide a convenient user feature to tie and close the opening of the bag. The lobes are grasped and knotted to seal the bag opening. Representatives of wave-cut or "tie bags" can be found in the following prior art of U.S. Pat. Nos. 4,890,736, 5,041,317, 5,246,110, 5,683,340, 5,611,627, 5,709,641, and 6,565,794.

In a further publication, U.S. Pat. Appl. Pub. 2008/0292222A1 discloses a bag having at least two "tie flaps" with gripping features embossed on at least one surface of the tie flaps. It is further disclosed that the bag may be formed from a tube of thermoplastic material. However, the publication further discloses that the gripping feature is formed in a linear fashion along a length of a blown film bubble that is then slit lengthwise in a wave pattern. The bubble is then formed into bags after being collapsed with a collapsed edge forming a bottom of the bag.

It has been determined, however, that the lobes of prior art wave-cut bags are often difficult to grasp and manipulate, especially if the lobes are contaminated with slippery trash contamination such as oil or grease or moist organic contaminants. Furthermore, wave-cut bags are often manufactured with thicker film than other types of trash bags since they often are intended for use with larger and heavier debris, such as yard debris and debris from home improvement projects. These thicker films used on larger wave-cut bags can be as thick as 3 mils and make it challenging for a user to manipulate the lobes of a wave-cut bag into a knot. Hence, it would be desirable to provide a wave-cut bag that has easier to grasp lobes that are also thinner than the rest of the bag. The present invention represents a novel solution to address this need.

It has also been determined that for certain thicknesses of wave-cut trash bags it may be desirable to provide a bag with thicker lobes relative to thinner a central body of the bag. Thicker lobes may provide a perception of strength to a user when handling the bag and also provide a bag that forms a more robust closure. The thinner body of the bag allows a manufacturer to provide thicker lobes that are desired by consumers while also using less raw material than would otherwise be required to form a bag with a uniform thickness having the same thickness the area of the bag's lobes.

SUMMARY OF THE PRESENT INVENTION

In at least one embodiment of the present invention, a bag of polymeric film may be formed. To form the polymeric bag, a collapsed tube of polymeric film may be formed with a machine direction. The collapsed tube may be formed from a blown film extrusion process. Once the collapsed tube is formed, a pair of intermeshing rollers may intermittently engage the collapsed tube to form a plurality of incrementally stretched sections on the collapsed tube. Within each incrementally stretched section may be defined a plurality of thin and thick ribs that extend across a width of the collapsed tube. The plurality of thin and thick ribs may be parallel to each other and transverse to the machine direction of the collapsed tube. The pair of intermeshing rollers may stretch the collapsed tube in the machine direction.

Once the collapsed tube is incrementally stretched, a bag converting operation may form the collapsed tube into a plurality of bags. Each one of the plurality of bags may have at least a fraction of one of the plurality of incrementally stretched sections. A wave-cutting operation may divide each of the incrementally stretched sections into two separate components. Each of the two separate components may be approximately one-half of an incrementally stretched section. One half of an incrementally stretched section may define an incrementally stretched portion on a first trash bag and a second half of an incrementally stretched section may define an incrementally stretched portion on a second trash bag.

The bag converting operation may further comprise forming sets of closely spaced, parallel seals extending transversely across the entire width of the collapsed tube. Each set of closely spaced parallel seals may be at equally spaced intervals from each other. The bag converting operation may also form perforation lines extending transversely across the entire width of the collapsed tube with a perforation line located between each set of closely spaced, parallel seals. A plurality of wave-shaped perforations may also be formed in the collapsed tube. A location of each wave-shaped perforation may be equidistant from adjacent perforation lines. Each wave-shaped perforation may be centered within one of the plurality of incrementally stretched sections.

The converting operation may further comprise a timing operation. The timing operation may detect the location of each perforation line and generate a timing signal. The location of each wave-shaped perforation and perforation line may be based upon the timing signal. The timing operation may be a standalone operation or may be integrated into the bag converting operation.

The pair of rollers may counter-rotate in relation to each other so that the collapsed tube is fed through the pair of intermeshing rollers. A rotational axis of each of the pair of intermeshing rollers may be perpendicular to the machine direction of the collapsed tube. Each roller of the pair of intermeshing rollers may include a plurality of protruding ridges extending completely about a circumference of each roller. The plurality of protruding ridges may also only extend about a partial circumference of each roller. Each of the protruding ridges may be parallel to each other and parallel to the axis of rotation of each roller. Each of the protruding ridges may have a tip protruding radially outward from the axis of rotation of one of the pair of intermeshing rollers. The plurality of protruding ridges of one roller may intermesh with the plurality of protruding ridges of the other roller. The pair of intermeshing rollers may intermesh with each other only over a fraction of a circumference of each roller and only incrementally stretch the collapsed tube when the pair of intermeshing rollers are intermeshed. The pair of intermeshing rollers may be separated by a gap when the rollers are not intermeshed.

The pair of intermeshing rollers may rotate at a constant speed so that a tangential (i.e. circumferential) speed of the rollers matches the linear speed of the collapsed tube. The rotational speed of the intermeshing rollers may also oscillate so that the tangential speed of the rollers match the linear speed of the collapsed tube when the rollers are intermeshed and when the rollers are not intermeshed the tangential speed of the rollers is slower than the linear speed of the collapsed tube.

In a further embodiment of the present invention, a bag is formed form a collapsed tube of polymeric film. The bag may comprise a first panel and a second panel. The first panel and the second panel may be joined along a first side edge, a second side edge, and a bottom edge. The first side edge may be formed from a first edge of the collapsed tube and the second side edge may be formed from a second edge of the collapsed tube. The first panel may have a first top edge opposite the bottom edge and the second panel may have a second top edge opposite the bottom edge. The first top edge and second top edge may define an opening of the bag. A distal end of both the top edge and second top edge may have a wave-shaped profile and the wave-shaped profile may define a plurality of lobes.

A plurality of ribs may be defined in the plurality of lobes. The plurality of ribs may be generally parallel to each other and each rib may extend from the first side edge towards the second side edge of the bag. Each rib may extend perpendicularly from the first side edge to the second side edge. A closure of the bottom edge may be formed from a seal extending transversely across the entire width of the collapsed tube. The wave-shaped profile may define a profile height and the plurality of ribs may extend below a bottom of the wave-shaped profile approximately one-half length of the profile height. The plurality of ribs may also extend below the bottom of the wave-shaped profile no more than a length of the profile height, or more than a length of the profile height. The plurality of ribs may result from incremental stretching of the polymeric film in the machine direction. The incremental stretching may be due to a pair of intermeshing rollers that intermittently incrementally stretch the collapsed tube. The pair of intermeshing rollers may have at least two rotational speeds. The pair of intermeshing rollers may rotate slower when incrementally stretching the collapsed tube than when not incrementally stretching the collapsed tube.

BRIEF DESCRIPTION OF THE RELATED DRAWINGS

A full and complete understanding of the present invention may be obtained by reference to the detailed description of the present invention and certain embodiments when viewed with reference to the accompanying drawings. The drawings can be briefly described as follows.

FIG. 1 depicts a perspective view of a first embodiment of the present invention.

FIG. 2*a* depicts a partial perspective view of the first embodiment of the present invention.

FIG. 2*b* depicts a partial perspective view of an alternate second embodiment of the present invention.

FIG. 3*a* depicts a perspective view of an incremental stretching operation of the first and second embodiments.

FIG. 3*b* depicts a secondary perspective view of the incremental stretching operation of the first and second embodiments.

FIG. 4*a* depicts a perspective view of an incremental stretching operation of a third embodiment of the present invention.

FIG. 4*b* depicts a perspective view of an incremental stretching operation of a fourth embodiment of the present invention.

DETAILED DESCRIPTION OF THE INVENTION

The present disclosure illustrates several embodiments of the present invention. It is not intended to provide an illustration or encompass all embodiments contemplated by the present invention. In view of the disclosure of the present invention contained herein, a person having ordinary skill in the art will recognize that innumerable modifications and insubstantial changes may be incorporated or otherwise included within the present invention without diverging from the spirit of the invention. Therefore, it is understood that the present invention is not limited to those embodiments disclosed herein. The appended claims are intended to more fully and accurately encompass the invention to the fullest extent possible, but it is fully appreciated that certain limitations on the use of particular terms are not intended to conclusively limit the scope of protection.

Figure 1:
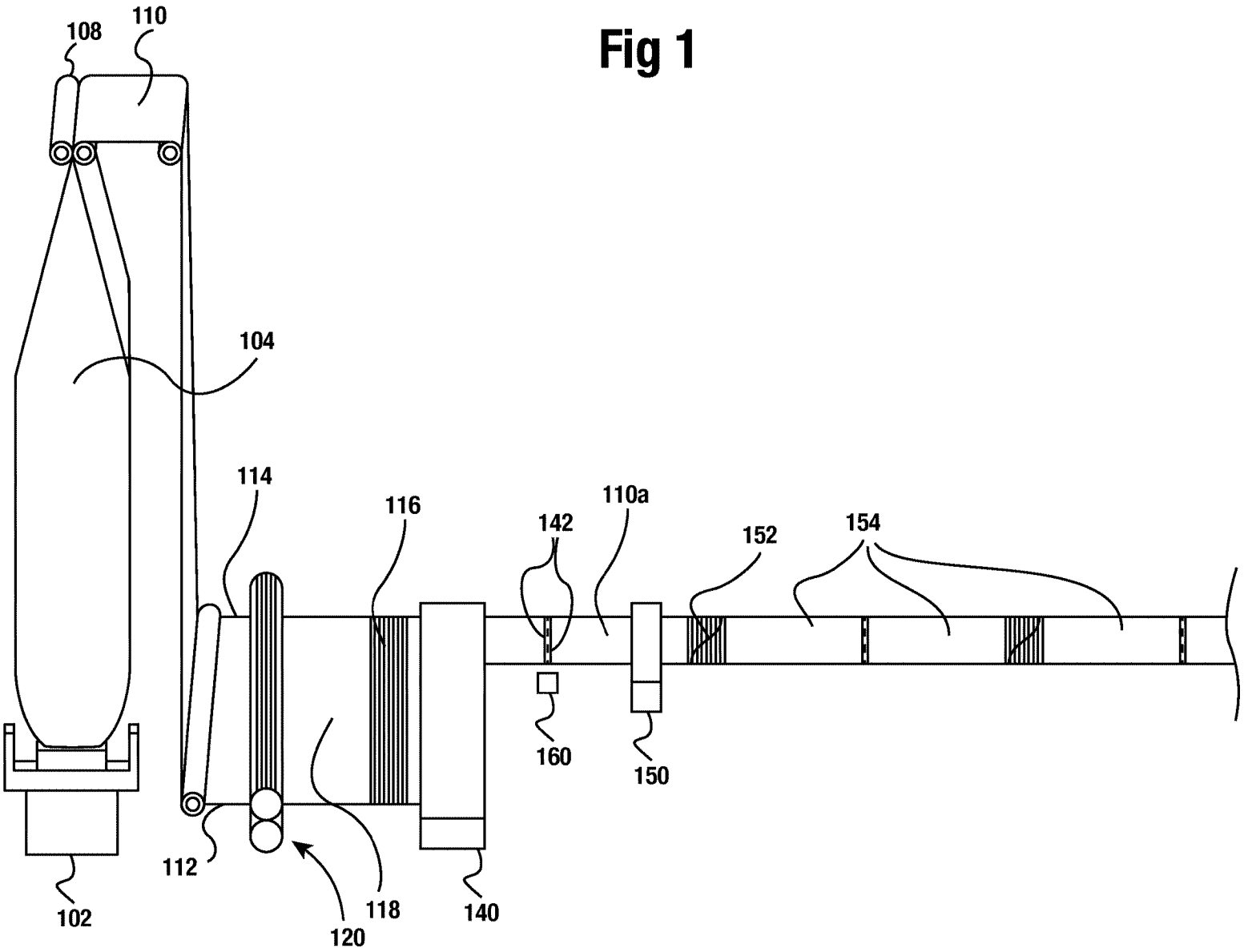
Figure 2A:
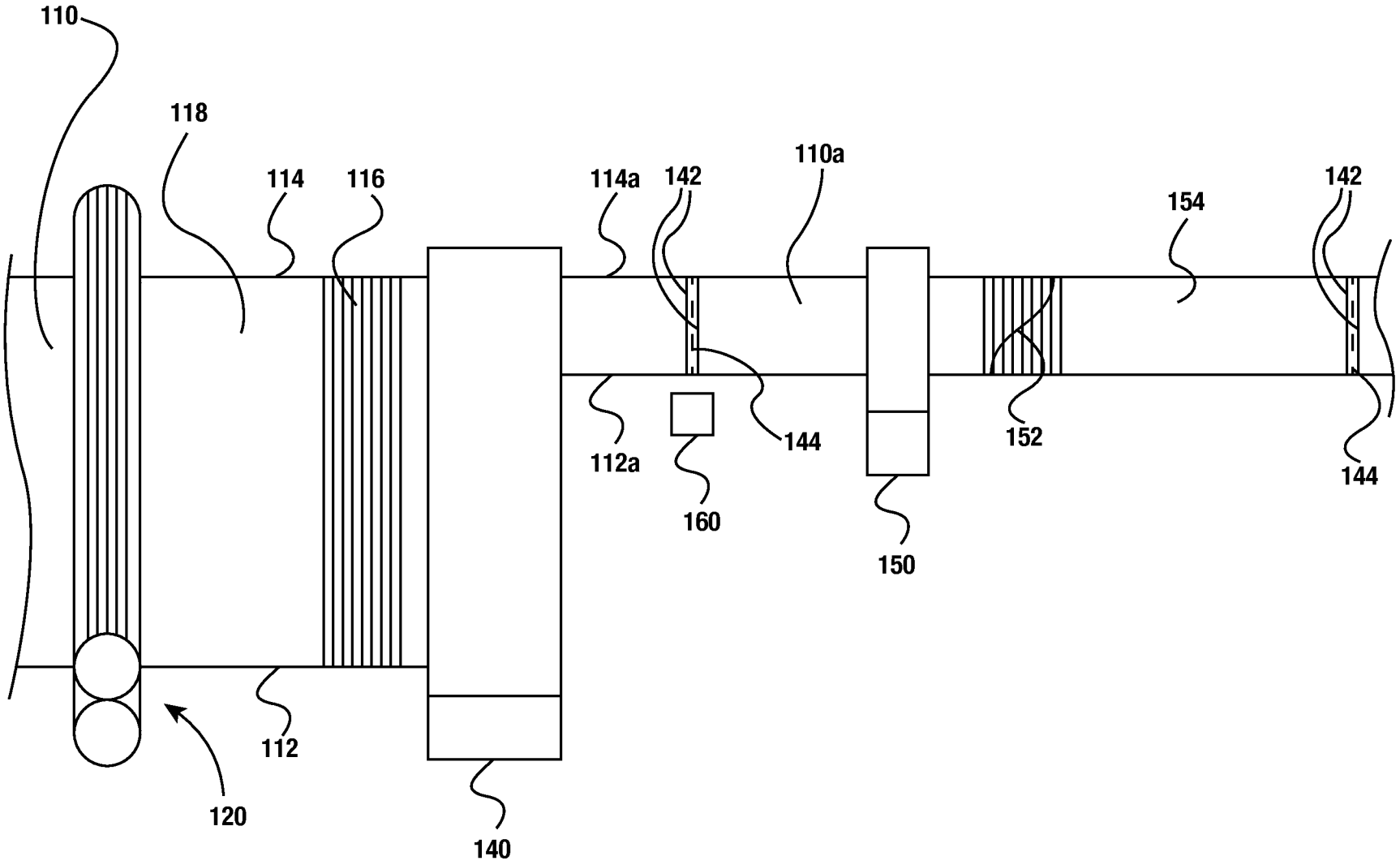

Referring initially to FIGS. 1 and 2*a*, a process for forming wave-cut trash bags with incrementally stretched tie flaps or lobes is shown. The trash bags may be formed by a blown film extrusion process. The blown film extrusion process begins by molten polymeric resin being extruded through an annular die of an extruder 102 to form a bubble or tube of molten polymeric film 104. The direction that the film is extruded out of the die is commonly referred to as the machine direction (MD). The direction of extrusion may also be referred to as the lengthwise direction of the bubble or polymeric film tube 104. Hence, the length of the polymeric tube 104 extends parallel with the machine direction. The direction transverse to the machine direction is commonly referred to as the cross direction (CD). The blown film extrusion process is well known in the art and is further explained in U.S. Pat. No. 7,753,666, which is hereby incorporated by reference in its entirety.

The polymeric resin used in the blown film extrusion process may vary. However, for forming polymeric bags, a polyethylene resin is commonly used. In the current state of the art for polymeric bags, a blend of various polyethylene polymers may be used. A polymer blend can have linear low-density polyethylene (LLDPE) as the primary component, but other polymers may be utilized including, but not limited to, other polyethylene resins such as high-density polyethylene (HDPE) or low-density polyethylene (LDPE). Typically, the primary component of the polymer blend, such as linear low-density polyethylene (LLDPE), will comprise at least 75% of the polymer blend. The remaining portion of the polymer blend may include additives including, but not limited to, coloring additives, anti-blocking agents, and/or odor control additives. The film utilized to form polymeric bags may also comprise multiple layers of blown film resin. The resultant multi-layer film may be formed by coextrusion, a lamination process, or other methods of forming a multi-layer film known in the art. In each layer, one or more of the above-discussed polymers may be used.

As shown in FIG. 1, once the bubble 104, or polymeric tube, of molten film solidifies, the bubble 104 is collapsed by a pair of nip rollers 108, which results in a collapsed tube 110. The collapsed tube 110 includes two opposing interconnected surfaces of film extending continuously in a lengthwise direction. This continuously extending surface of film may be referred to as a web. The nip rollers 108 are commonly elevated above the extruder 106 a considerable distance, since the molten bubble 104 is air-cooled and requires a relatively large vertical distance to cool and solidify before the bubble 104 is collapsed.

As shown in FIG. 2*a*, once collapsed, the collapsed tube 110 has a first edge 112 and second edge 114 defined in the opposing edges of the collapsed tube 110 extending the length of the collapsed tube 110. The distance from the first edge 112 to the second edge 114 of the collapsed tube 110 can define a width of the collapsed bubble. Once the collapsed tube 110 returns from the cooling tower (not shown), the collapsed tube 110 can feed directly into an incremental stretching operation 120; hence the incremental stretching can be performed as an in-line process, synchronously, with the blown film extrusion. As shown in FIG. 1 and more clearly in FIG. 2*a*, the incremental stretching operation 120 can be configured to only intermittently stretch the collapsed tube 110, leading to incrementally stretched partial lengths of the collapsed tube 110.

Figure 3A:
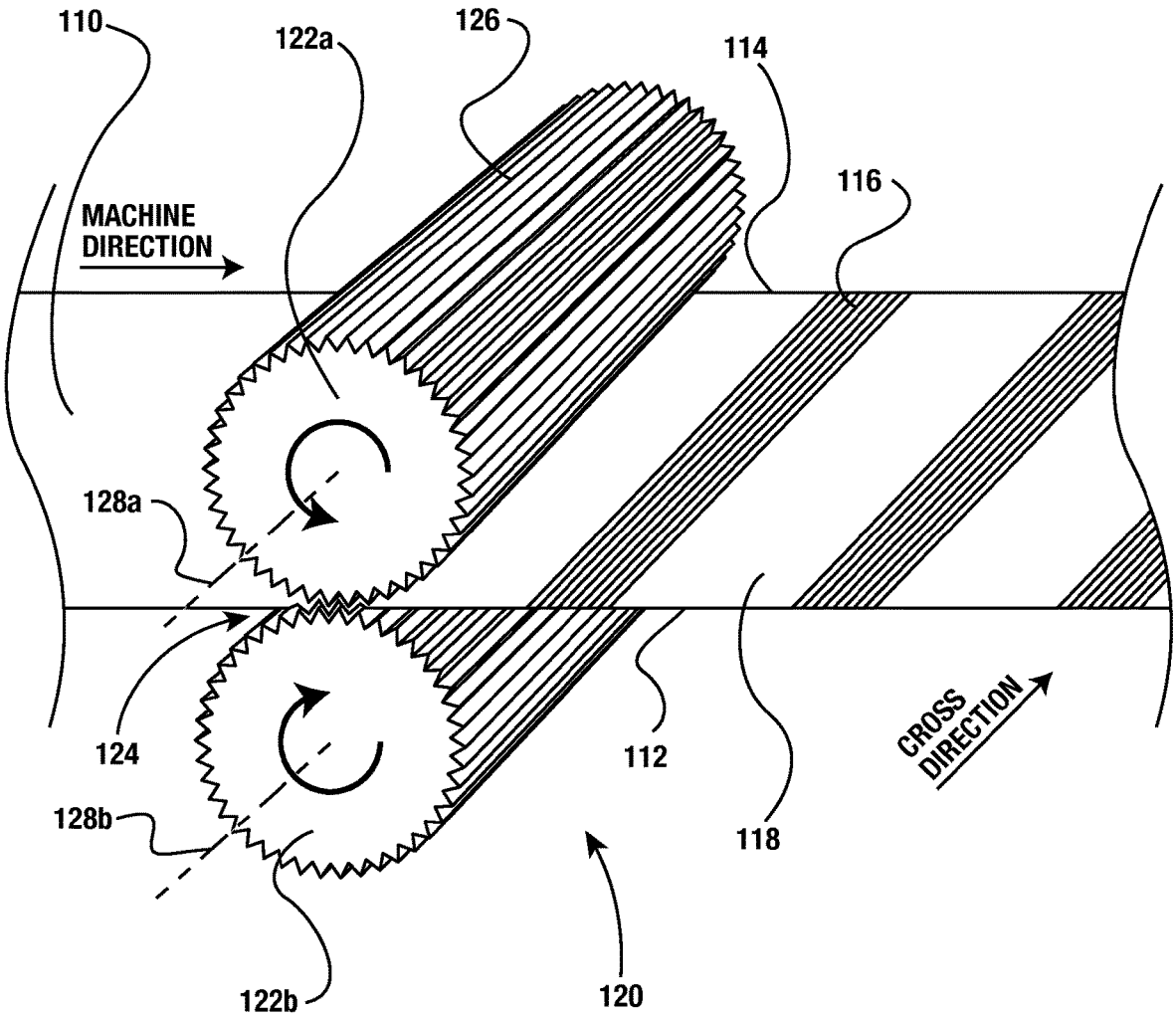

As shown in FIGS. 3*a*-4*b*, the incremental stretching operation 120 can include a pair of intermeshing rollers 122*a*, 122*b*. The diameter and length of each intermeshing roller 122*a*, 122*b* are equal in a preferred embodiment but may vary. As best shown in FIG. 3*a*, the collapsed tube 110 can enter a nip 124 defined by the pair of intermeshing rollers 122*a*, 122*b*. The rotational axes 128*a*, 128*b* of each roller 122*a*, 122*b* can be parallel to each other and transverse to the machine direction (MD) of the collapsed tube 110. Each of the rollers 122*a*, 122*b* can have a plurality of protruding ridges 126 parallel to the axis of each roller 128*a*, 128*b* that extend around the entire circumference of each roller 122*a*, 122*b* at a constant spacing. The protruding ridges 126 of the rollers 122*a*, 122*b* can be configured to intermesh like gears. As the collapsed tube 110 enters the nip of the intermeshing rollers 122*a*, 122*b*, the film of the collapsed tube 110 is stretched based upon the depth and spacing of the grooves 126.

As best shown in FIG. 3*a*, the film of the collapsed tube 110 is stretched by each groove of the plurality of protruding ridges 126 in the machine direction, which results in a pattern of stretched and un-stretched lengths with each length extending along the width or cross-direction of the collapsed tube 110. Examined closely, this pattern of stretched and un-stretched lengths results in a pattern of parallel thick ribs (un-stretched lengths) and thin ribs (stretched lengths) extending in the cross-direction of the collapsed tube 110 for each incrementally stretched section 116.

The preferred actual size and spacing of each of the plurality of protruding ridges 126 in relation to each of the rollers 122*a*, 122*b* is substantially exaggerated for ease of illustration in the figures. In one preferred embodiment, the spacing of the grooves can be 20 grooves per inch about the circumference of each roller 122*a*, 122*b*, with each groove leading to a matching thin rib/thick rib extending along the width of the collapsed tube 110. The spacing of the ribs in the film after stretching is greater than the groove spacing of the intermeshing rollers 122*a*, 122*b*, since the stretching causes the ribs to spread away from each other. The pattern of thick and thin ribs is represented by a pattern of parallel and adjacent lines in the figures.

Figure 3B:
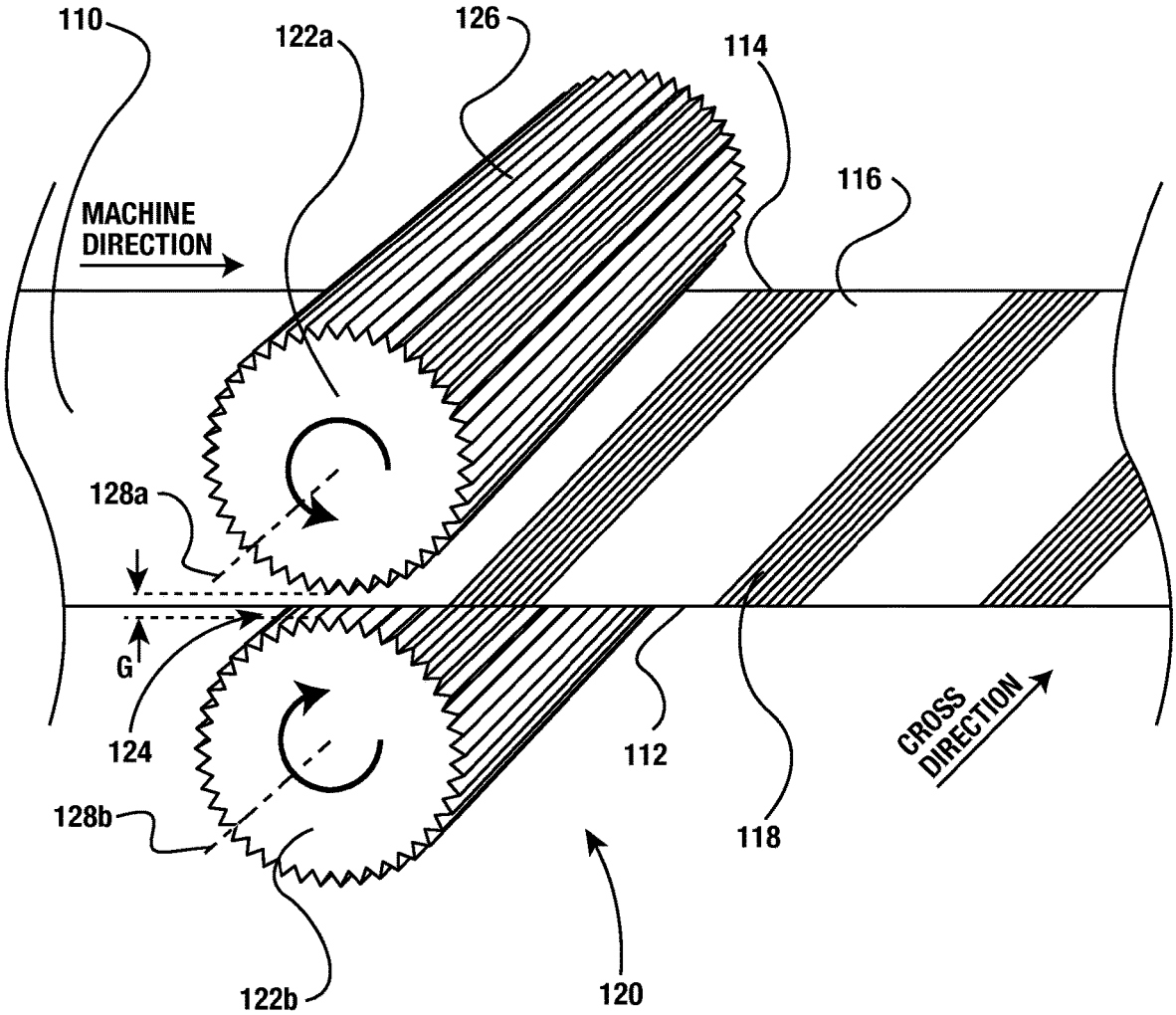

Once again examining FIG. 3*a* and FIG. 3*b*, the incremental stretching operation 120 can be configured to only engage, and hence only incrementally stretch, the collapsed tube 110 intermittently. This intermittent engagement of the collapsed tube 110 leads to lengths of un-stretched sections 118 and lengths of incrementally stretched sections 116. As illustrated in FIG. 3*b*, the intermittent engagement of the collapsed tube 110 can be accomplished by the pair of intermeshing rollers 122*a*, 122*b* moving away from each other a certain distance G allowing the collapsed tube 110 to move past the incremental stretching operation 120 without being stretched by the intermeshing rollers 122*a*, 122*b*. The gap G, as shown in FIG. 3*b*, must be large enough to allow the collapsed tube 110 to pass through the nip 124 without interference from the intermeshing rollers 122*a*, 122*b*.

Figure 4A:
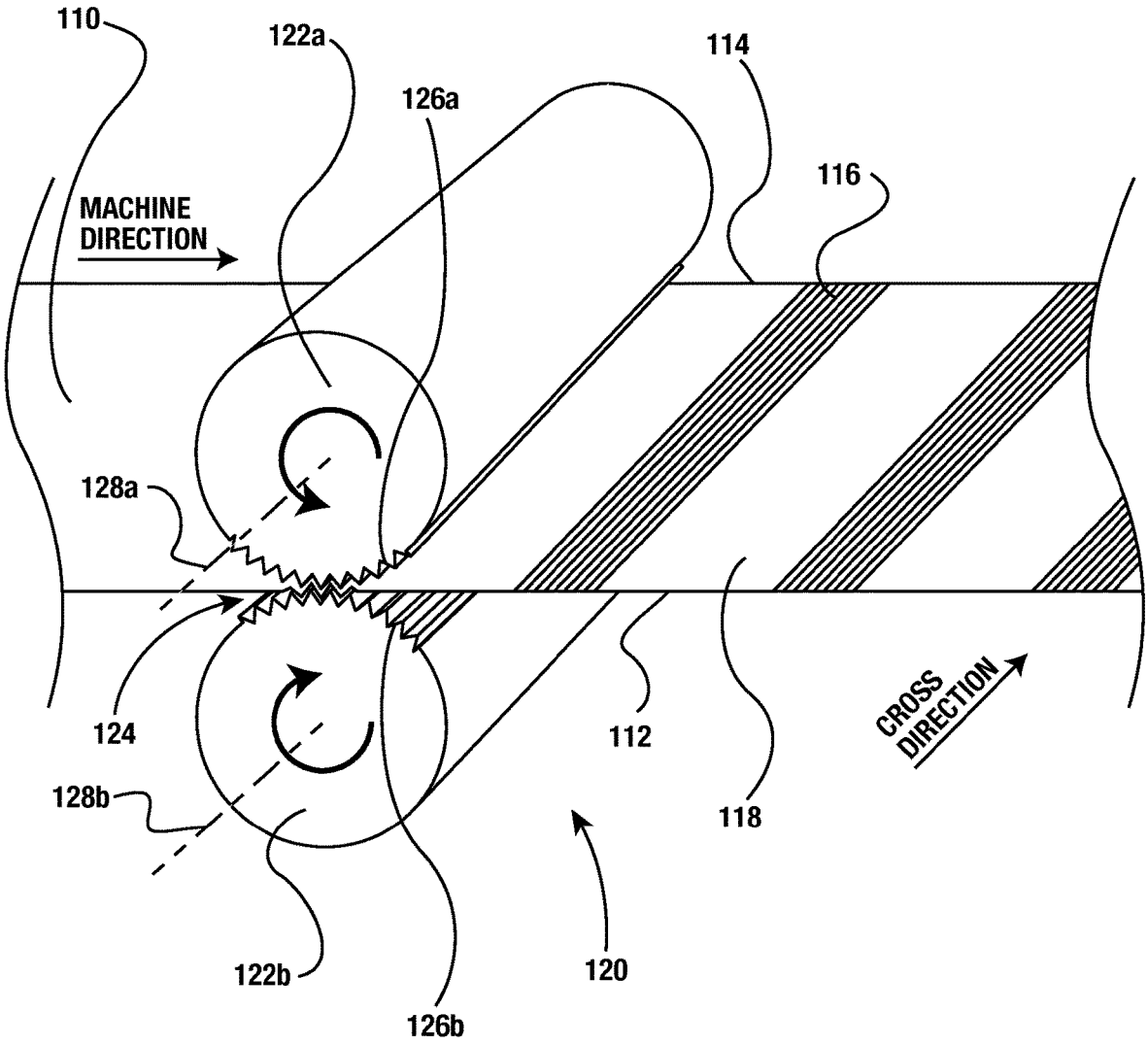
Figure 4B:
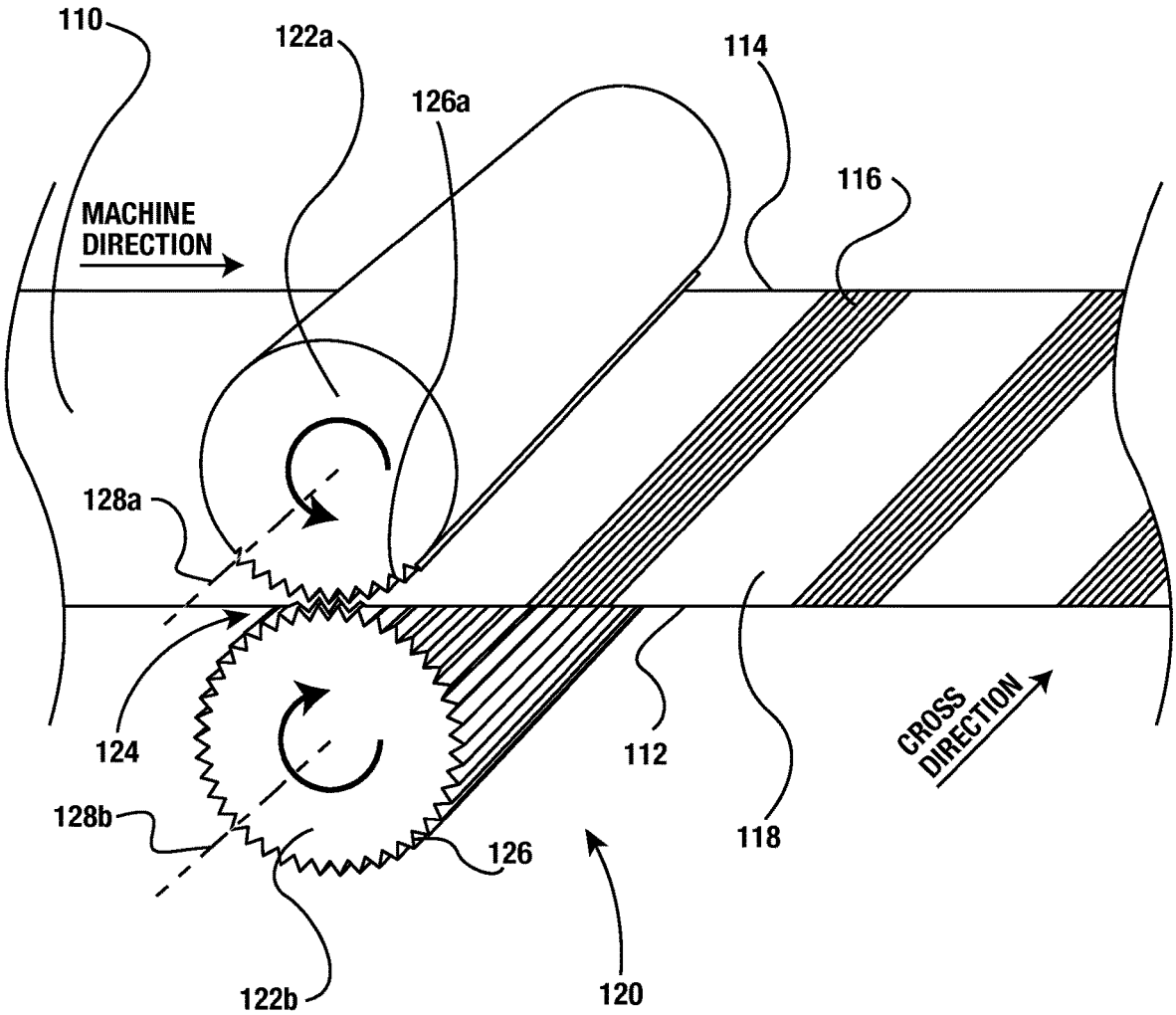

Shown in FIG. 4*a* is an alternative method of intermittently incrementally stretching the collapsed tube 110. Unlike the previous embodiment of the incremental stretching operation 120 shown in FIGS. 3*a* and 3*b*, the rotational axes 128*c*, 128*d* of the pair of intermeshing rollers 122*a*, 122*b* are mounted stationary in relation to each other. However, the protruding ridges 126*a*, 126*b* extend only partially around the circumference of each roller 122*a*, 122*b* rather than about the entire circumference. The locations of the protruding ridges 126*a*, 126*b* on each roller 122*a*, 122*b* are spaced appropriately so that the protruding ridges 126*a*, 126*b* intermesh when the pair of rollers 122*a*, 122*b* revolve. Thus, the collapsed tube 110 is incrementally stretched only when the protruding ridges 126*a*, 126*b* intermesh and engage the collapsed tube 110. The geometry of each roller 122*a*, 122*b* can be configured so that the collapsed tube 110 is not in contact with either of the rollers 122*a*, 122*b* when not engaged with the protruding ridges 126*a*, 126*b*. In the alternative, the diameter of each roller 122*a*, 122*b*, can be configured such that the surface of one or more of the rollers 122*a*, 122*b* is in contact with the collapsed tube 110 while the protruding ridges 126*a*, 126*b* are not intermeshed. One or more of the rollers 122*a*, 122*b* in contact with the collapsed tube 110, when the protruding ridges 126*a*, 126*b* are not engaging the collapsed tube 110, may assist in maintaining the desired tension in the collapsed tube 110.

The rollers of FIG. 4*a* may rotate at a speed so that a tangential speed of each roller 122*a*, 122*b* matches a linear speed of the collapsed tube 110 passing through the nip 124. In the alternative, the tangential speed of the rollers 122*a*, 122*b* may only match the speed of the collapsed tube 110 when the collapsed tube 110 is engaged by the protruding ridges 126*a*, 126*b*. When the protruding ridges 126*a*, 126*b* are not engaged, the rotational speed, and hence the tangential speed, of the pair of rollers 122*a*, 122*b* can be decreased. In this instance, the diameter of each roller 122*a*, 122*b* must be configured such that the collapsed tube 110 is not in contact with the rollers 122*a*, 122*b* when not engaged with the protruding ridges 126*a*, 126*b*, since the linear speed of the collapsed tube 110 is typically constant. Decreasing the speed of the rollers 122*a*, 122*b* when not engaged with the web has the advantage of allowing smaller diameter rollers than would be required if the rollers rotated at a constant speed.

In one particular example, the incremental stretching operation 120 may be configured such that each incrementally stretched section 116 of the collapsed tube 110 is 15 inches in length after being stretched and each un-stretched section 118 is 85 inches in length. For rollers that rotate at a constant speed, the intermeshing rollers can be configured to stretch the collapsed tube approximately 15 percent such that the protruding ridges would extend about the circumference of each roller approximately 13 inches, stretching a length of 13 inches of the collapsed tube 110, which results in a length of 15 inches after being stretched. The remaining smooth circumference of 85 inches would then be devoid of the protruding ridges, which results in a total circumference of approximately 98 inches and a diameter of approximately 31.2 inches for each roller 122*a*, 122*b*.

Unlike rollers that rotate at a constant speed, rollers 122*a*, 122*b* configured to run at an oscillating speed could have a smaller circumference and hence a smaller overall size. For instance, when not engaged, the rollers 122*a*, 122*b* could rotate with an average tangential speed of 50 percent of the linear speed of the web. The speed of the rollers 122*a*, 122*b* would not step down instantly to 50 percent. Thus, the rollers 122*a*, 122*b* would first decelerate, then rotate at a speed of less than 50 percent, and then accelerate prior to engaging the collapsed tube 110 again. This arrangement would only require a smooth partial circumference of one-half the previous smooth circumference of approximately 42.5 inches and a 13-inch partial circumference having protruding ridges 126*a*, 126*b* for a total circumference of approximately 55.5 inches and a diameter of approximately 17.7 inches for each roller 122*a*, 122*b*. It also foreseeable that the rollers could rotate at an average tangential speed of much less than 50 percent when not engaged with the collapsed tube, such as 25 percent.

Decreasing the diameter and hence the overall size of the rollers 122*a*, 122*b* offers several advantages. First, the cost to produce the rollers is decreased with rollers of decreased size. In addition, with smaller rollers, the time to manufacture the rollers may also be reduced. Smaller rollers lead to lighter weight rollers, which can lead to a mounting system for the rollers to be proportionally smaller and less expensive to construct. Lighter rollers may also lead to smaller, less expensive motors for driving the rollers. The use of smaller drive motors may also lead to less energy consumption.

As shown in FIG. 4*a*, the axes 128*a*, 128*b* of the rollers 122*a*, 122*b* can be located relative to the collapsed tube 110 so that the collapsed tube 110 passes equidistant from both rollers 122*a*, 122*b*. However, in an alternative embodiment shown in FIG. 4*b*, the collapsed tube 110 can be located slightly further away from the bottom roller 122*b* so that protruding ridges 126 may extend completely about the entire circumference of the bottom roller 122*b*. In such an embodiment, the collapsed tube 110 passes over the lower protruding ridges 126 when not engaged by the upper protruding ridges 126*a*. When the collapsed tube 110 is engaged by the upper protruding ridges 126*a*, the collapsed tube 110 is pushed down into the lower protruding ridges 126 by the upper protruding ridges 126*a*.

In an alternative embodiment, the above-described incremental stretching operation 120 can be performed on a single layer web of polymeric film. For instance, the collapsed tube 110 may be slit along the first edge 112 so that the tube is open along the first edge 112. The collapsed tube may then be spread out so that the two opposing layers of the collapsed tube 110 lie in the same plane adjacent to each other. The single layer web may then be intermittently incrementally stretched as described above. Once the stretching is complete, the web may be folded so that the two layers of the collapsed tube 110 once again oppose each other. The two layers of film adjacent to the first edge 112 may then be sealed together so that the collapsed tube 100 may still be used to form wave-cut trash bags. Performing the incremental stretching on one layer of film may prevent undesired binding of the two layers of film.

In another alternative embodiment, rather than the incremental stretching operation 120 performed in-line and synchronously, as described above, with the blown film extrusion 102, the incremental stretching 120 can be performed off-line from the blown film extrusion. For instance, once the polymeric bubble 104 is collapsed by the nip rollers 108, the collapsed tube 110 can be rolled onto a master roll. The master roll can then be placed at a lead end of the incremental stretching operation 110 and the collapsed tube can be unrolled from the master roll. The collapsed tube 110 can then be fed into the incremental stretching operation 120.

Figure 5:
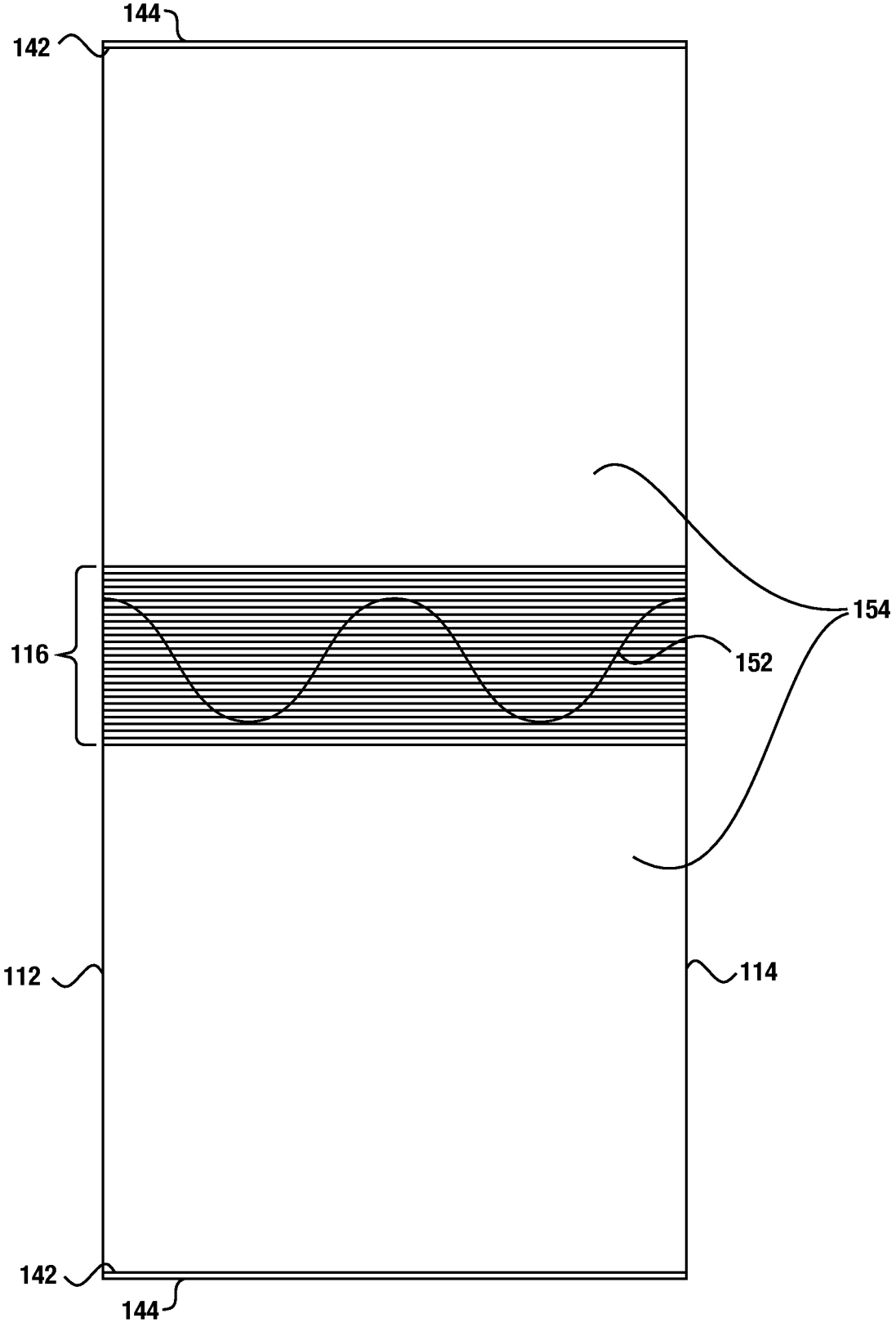
FIG. 5 depicts a front view of a fifth embodiment of the present invention.
Figure 6:
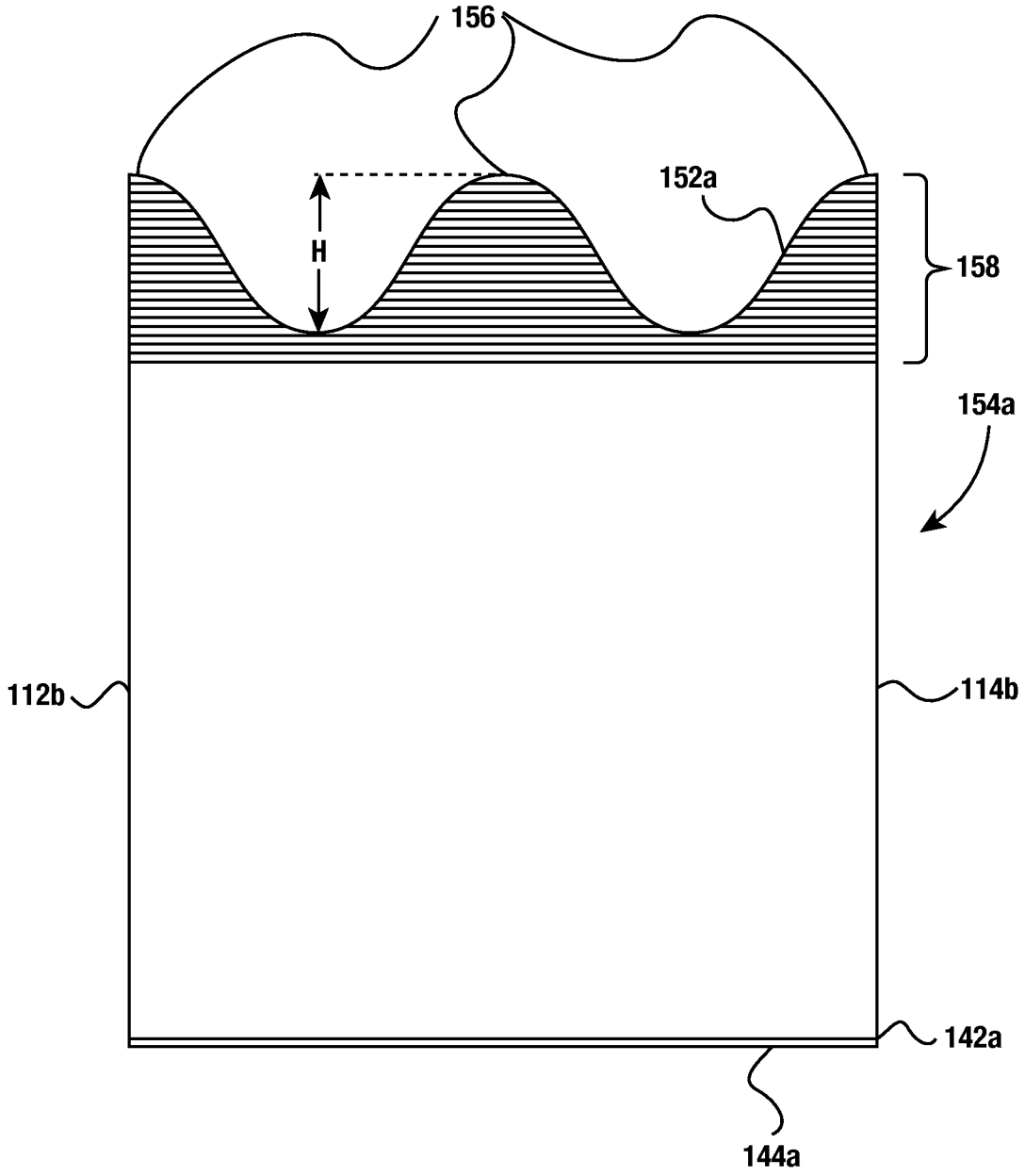
FIG. 6 depicts another front view of the fifth embodiment of the present invention.

Returning now to FIGS. 1 and 2*a*, once the incremental stretching is complete, the collapsed tube 110 can enter a bag converter 140. The bag converter 140 can form sets of closely spaced, parallel seals 142. The sets of closely spaced parallel seals 142 can extend transversely to the machine direction and across the entire width of the collapsed tube 110. As shown in FIGS. 5 and 6, one seal of each set 142 can define a bottom seal 142*a* for each bag 154*a*. As shown in FIG. 2*a*, between each set of the closely spaced parallel seals 142, the bag converter 140 can form perforation lines 144. The perforation lines 144 can extend transversely to the machine direction, the cross direction, and across the entire width of the collapsed tube 110. Each perforation line 144 can define the bag bottom 144*a* (shown in FIG. 5) and separation point of adjoining bags 154.

Once again examining FIG. 2*a*, once the sets of closely spaced parallel seals 142 and perforation lines 144 are formed, the bag converter 140 can fold the collapsed tube 110 one or more times, with each fold extending along the length of the collapsed tube 110 and parallel to the machine direction. In at least one particular embodiment, the collapsed tube 110 can be folded twice such that a width of the folded collapsed tube 110*a* is one-fourth the width of the un-folded collapsed tube 110. Once folded, a first folded edge 112*a* and second folded edge 114*a* can be defined in opposing edges of each bag 154.

Once the collapsed tube 110 is folded, it can proceed into a wave-cutter 150. The wave-cutter 150, which may also be referred to as a wave-cutting operation, creates wave-cuts 152. Wave-cuts 152 are wave-shaped perforations, extending across the width of the folded collapsed tube 110*a*. The wave-cuts 152 can perforate the folded collapsed tube 110*a* in the shape of a one-half sine wave extending across the width of the folded collapsed tube 110*a*. In one particular embodiment, the amplitude of the sine wave can be approximately 5 inches but may vary considerably. Due to the collapsed tube 110*a* being folded twice when each wave-cut 152 is made, when un-folded each wave-cut can have, in general, a shape of two full sine waves extending across the width of the collapsed tube 110.

The location of the wave-cut 152 in relation to the perforation line 144 can be controlled by a timing operation 160. The timing operation 160 can detect the location of each perforation line 144. The timing operation 160 can rely upon a laser beam, infrared light, a spark generator, or another form of an electromagnetic signal to detect each perforation line 144. The detected location of each perforation line 144, along with the fixed position of the timing operation 160 and the collapsed tube 110 traveling at a steady state, can be used to time the incremental stretching operation 120 and wave-cutting operation 150 so that each wave-cut 152 and incrementally stretched section 116 are placed at predetermined locations. The timing operation 160 may be a standalone operation or may be integrated into the bag converter 150.

In at least one preferred embodiment, each wave-cut 152 can be centered by the wave-cutter 150 about a height of an incrementally stretched section 116, in relation to the machine direction. Thus, a distance from a bottom of a wave-cut 152 to a lower boundary of an incrementally stretched section 116, the lower boundary separating an incrementally stretched section 116 from an un-stretched section 118, can be equal to a distance from a top of the wave-cut 152 to an upper boundary of the incrementally stretched section 116, the upper boundary opposite from the lower boundary. Each centered wave-cut 152 and incrementally stretched section 116 can be equidistant from adjacent perforation lines 144. In this preferred embodiment, once the collapsed tube 110 is separated at wave-cuts 152 and perforation lines 144 to form bags 154*a*, an approximate one-half length of an incrementally stretched section 116 is defined on each bag 154*a* (in relation to a mid-point or average of the waveform of the wave-cut 152).

In a particular example of this embodiment, the perforation lines 144 can be 100 inches away from each other. Each incrementally stretched section 116 and wave-cut 152 can also be separated from adjacent incrementally stretched sections 116 and wave-cuts 152 by 100 inches. Since the sections 116 and wave-cuts 152 are aligned or centered, a mid-point of each section 116 and wave-cut 152 is located 50 inches away from adjacent perforation lines 144.

Once the collapsed tube is folded and the wave-cuts 152 are placed, the folded collapsed tube 110*a* may be separated at the perforation lines 144 and wave-cuts 152 into individual bags 154 with each bag having a height of approximately 50 inches. Each bag 154 may then be overlapped with an adjoining bag and rolled into a roll of bags as is known in the art.

Figure 2B:
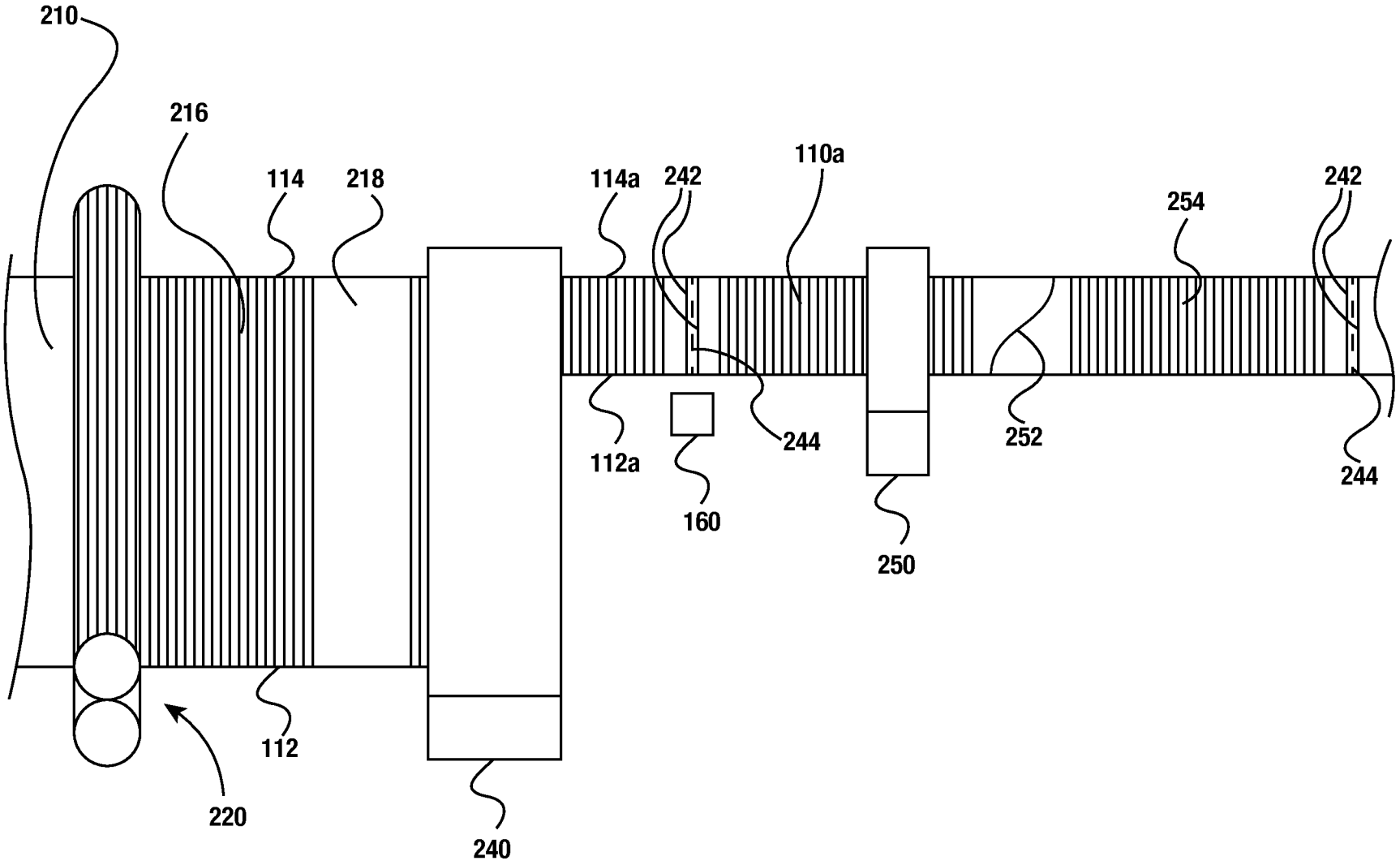

Shown in FIG. 2*b* is alternative embodiment to the embodiment illustrated in FIG. 2*a*. The bag conversion process shown in FIG. 2*b* is similar to the processes described for FIG. 2*a* except for the length and relative location of each incrementally stretched section. The incremental stretching operation 220 of FIG. 2*b* is configured to stretch a greater length of collapsed tube 110 relative to the incrementally stretched section 116 of FIG. 2*a*, resulting in incrementally stretched sections 216 and un-stretched sections 218. After being incrementally stretched, bag converter 240 can form sets of closely spaced parallel seals 242 centered about a height of an un-stretched section 218 and perforation lines 244 centered within each set of closely spaced seals 242.

Further shown in FIG. 2*b* is wave-cutter 250 configured to place each wave-cut 252 centered about a height of another un-stretched section 218 resulting in individual bags 254 with a top open edge defined by wave-cut 252 and bottom seal 244. An incrementally stretched section 216 is located in a central body and a first un-stretched section is located below the stretched body and a second un-stretched section is located above the stretched body. Other details of the bag conversion processes of FIG. 2*b* are not explained further since it is duplicative with the processes as explained above for FIG. 2*a*.

As one skilled in the may ascertain, the length of each incrementally stretched section 216 is greater than the incrementally stretched section 116 of FIG. 2*a*. For instance, rather than a stretched length of 15 inches as described for FIG. 2*a*, the incremental stretching process 220 may be configured to stretch the collapsed tube 210 approximately 30 inches when configured for manufacturing bags with a total height of 50 inches. This height could vary, however, depending upon the size of bag being manufactured and the desired length of the stretched body of the bag. The stretched body of the bag may centered between the bottom and top of the bag or it may be offset to a degree towards the bottom or top of the bag. For similar sized bags as described for FIG. 2*a*, the other dimensions discussed above would remain unchanged. However, the size of the rollers necessary for the incremental stretching operation discussed above would change proportionally to accomplish the increased length of the incrementally stretched section.

FIGS. 5 and 6 show in detail the structure of the trash bags 154 that may be formed from the above-described processes of FIGS. 1, 2*a*, and 3*a*-4*b*. FIG. 5 shows that once adjacent perforation lines 144 are separated, a matching pair of interconnected trash bags 154 are defined. A boundary of each trash bag is defined by one of the wave-cuts 152. An incrementally stretched section 116 is shown located on the two adjoining bags 154. Further shown is first edge 112 and second edge 114 of the collapsed tube 110 defining two opposing sides of the two adjoining bags 154. Two opposing perforation lines 144 are shown defining a bottom of each adjoining bag 154. Once the perforated wave-cut 152 is separated, two separate trash bags result. One of the resultant trash bags 154*a* is shown in FIG. 6.

As shown in FIG. 6, each wave-cut trash bag 154*a* can comprise a front panel and a rear panel formed from opposing sides of the collapsed tube 110. The trash bag 154*a* can have a first side edge 112*b* defined by the first edge 112 of the collapse tube 110 and a second side edge 114*b* defined by the second edge 114 of the collapsed tube 110. The trash bag 154 can further have a bottom seal 142*a* defined by one seal of the closely spaced sets of seals 142. A bag bottom 144*a* can be defined by one of the perforation lines 144. The bag top 152*a* can be defined by one of the wave-cuts 152. The bag top 152*a* can have a wave-cut profile. The bag top 152*a* can be defined on both the front panel and back panel of the bag 154*a* and the bag top 152*a* can define a bag opening.

As shown in FIGS. 2, 5 and 6, an incrementally stretched portion 158 of the trash bag 154*a* can be comprised of an incrementally stretched section 116 of the collapsed tube 110. The incrementally stretched portion 158 can be a fractional length of one of the incrementally stretched sections 116. Within the incrementally stretched portion 158, a plurality of lobes 156 can be defined. The plurality of lobes 156 may also be referred to as tie-flaps. A wave-cut profile height H can be defined as a vertical distance from a top of the wave-cut profile to a bottom of the wave-cut profile, the wave-cut profile height H equal to an amplitude of the wave shape of the wave-cut profile. The incrementally stretched portion 158 can extend from the bag top 152*a* to at least the bottom of the wave-cut profile. However, at least in one embodiment, the incrementally stretched portion 158 can extend below the bottom of the wave-cut profile up to one-half the wave-cut profile height H. In an alternative embodiment, the incrementally stretched portion 158 can extend below the bottom of the wave-cut profile at least a distance equal to the wave-cut profile height H. The incrementally stretched portion 158 can define a plurality of ribs extending from the first side edge 112*b* to the second side edge 114*b* of the bag 154*a*. The plurality of ribs can generally be parallel to each other and transverse to both the first side edge 112*b* and second side edge 114*b*.

In one particular example of the wave-cut trash bag 154*a*, a height of the bag from the bag bottom 144*a* to the upper extent of the bag top 152*a* may be 50 inches. A width of the bag from the first side edge 112*b* to the second side edge 114*b* may be approximately 33 inches. The wave-cut profile height H may be 5 inches with the incrementally stretched portion 158 extending 2.5 inches below the bottom of the wave-cut profile. Thus, the incrementally stretched portion 158 may have a height of approximately 7.5 inches, resulting in the remaining 42.5 inches of bag height un-stretched. The incrementally stretched portion 158 may be stretched approximately 15%. Thus, if the film of the collapsed tube is formed with a thickness of 3 mil, the incrementally stretched portion 158 may have an average thickness of approximately 2.5 mil with the remaining portions of the bag having a thickness of 3 mil.

Figure 7:
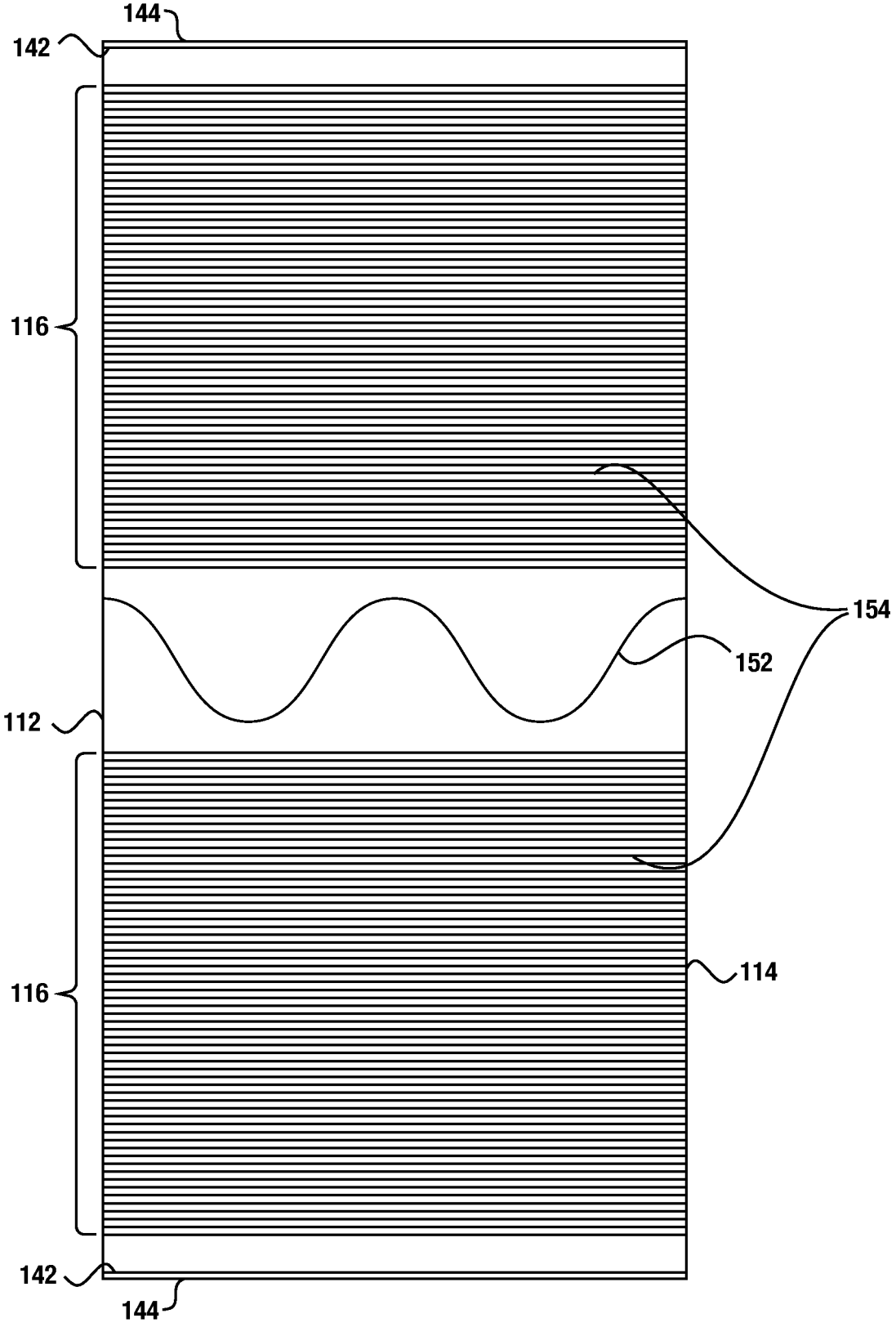
FIG. 7 depicts a front view of a sixth embodiment of the present invention.
Figure 8:
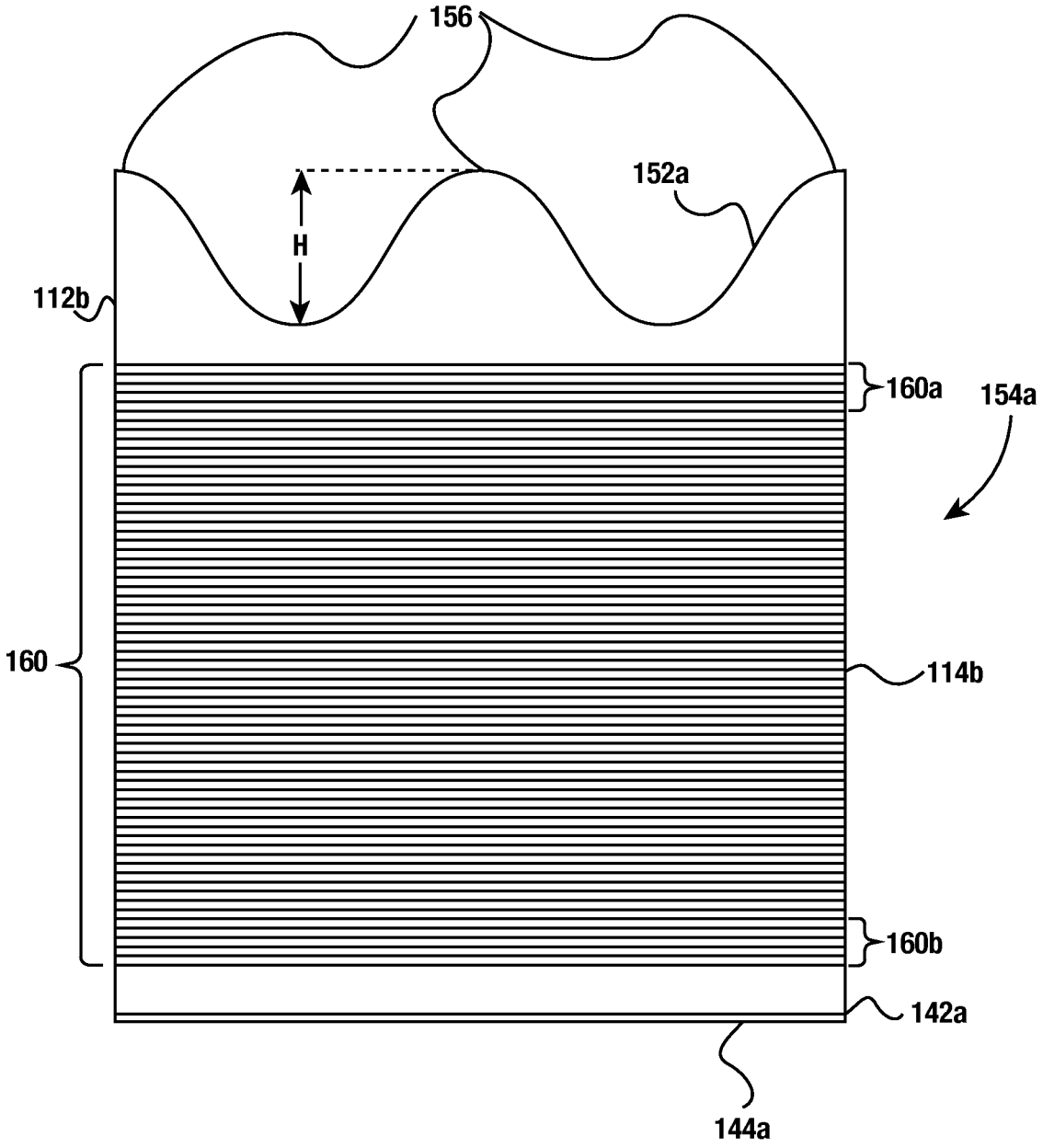
FIG. 8 depicts another front view of the sixth embodiment of the present invention.

Shown in FIGS. 7 and 8 is an alternative embodiment of the invention formed by the processes detailed by FIG. 2*b* as described above. Rather than each incrementally stretched section 116 aligned with one of the wave-cuts 152, each incrementally stretched section 116 can be offset from each wave-cut 152, as explained for FIG. 2*b* above. In this embodiment, each incrementally stretched section 116 is between adjacent perforation lines 140 and wave-cuts 152 so that a bag body 160 of each resultant bag 154 is incrementally stretched. The bag body 160 can be located between the lower extent of the bag top 152*a* and the bag bottom 144*a*.

Further shown in FIG. 8 are incrementally stretched transition zones 160*a* and 160*b*. It has been determined that when a polymeric web undergoes an incremental stretching operation as discussed above, the film of the web undergoes a transition from un-stretched film to fully incrementally stretched film. This transition is represented by the transitions zones 160*a* and 160*b* shown in FIG. 8. The structure of these transition zones is further detailed below in the discussion of FIG. 11.

In one particular example of the embodiment shown in FIGS. 7 and 8, the intermeshing rollers 122*a*, 122*b* can engage the collapsed tube 110 approximately 2.5 inches away from each side of each perforation line 142. Each incrementally stretched section 116 can be approximately 40 inches long, which results in a length of approximately 7.5 inches of un-stretched film from the upper extent of the bag top 152*a* to a top of the incrementally stretched bag body 160 for a bag having a total length of 50 inches. The bag body 160 can be stretched approximately 17 percent so that an initial film thickness of 3 mil is stretched to approximately 2.5 mil within the bag body 160. This embodiment allows less film, and hence less polymeric material, to be used than an otherwise similar un-stretched bag.

It is foreseeable, however, that the bag may disclosed in FIGS. 7 and 8 be shorter in length, such as 33 inches in length, since it is contemplated that bag 154*a* with an incrementally stretched body would be desirable for thinner wave-cut bags between 1-2 mils than the heavier 3 mil thick bags. Nonetheless, for bags in shorter lengths, such as 33 inches, it is contemplated that the other above discussed dimensions would be proportional to the dimensions discussed above for a bag having a length of 50 inches. It is further contemplated that a desirable thickness of bag 154*a*, as illustrated by FIG. 8, with a length of 33 inches may be approximately 1.3 mils. In at least one embodiment, it may be desirable to stretch central body of such a bag approximately 20% that results in the gauge by weight of the bag body being approximately one mils.

The embodiment shown in FIGS. 7 and 8 may also be implemented on a wave-cut trash bag having typical dimensions of a kitchen trash bag with. The bag body 160 can be stretched approximately 16 percent so that an initial film thickness of 0.7 mil is stretched to approximately 0.6 mil within the bag body 160.

Figure 9:
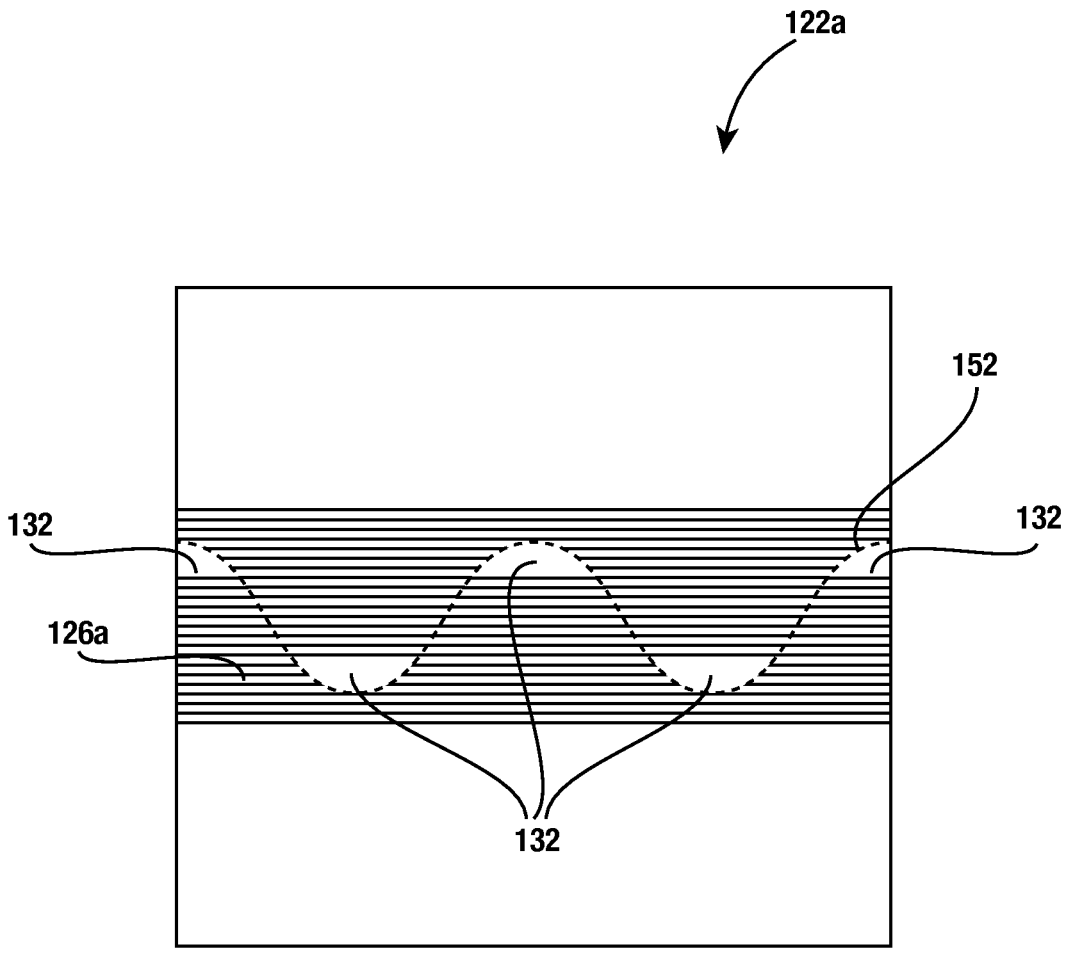
FIG. 9 depicts a top planar view of an intermeshing roller of a seventh embodiment of the present invention.

FIG. 9 illustrates yet another embodiment of the incremental stretching operation. Shown in FIG. 9 is a top planar view of an alternate embodiment of the outer surface of upper intermeshing roller 122*a*. The closely spaced parallel lines of FIG. 9 represent edges of each protruding ridge 126*a*. Although not to the same extend as previous illustrations, the spacing between adjacent ridges is exaggerated for ease of illustration. For reference, shown in dashed lines is the outline of the intended corresponding placement of a wave-cut 152. Within the plurality of protruding ridges 126*a* is shown a plurality of ridge voids 132. Each ridge void 132 is a location from which a length of protruding ridges has been removed from the intermeshing roller 122*a*. Each ridge void 132 defines a location where the intermeshing roller 122*a* will fail to stretch the collapsed tube 110 within each incrementally stretched section 116. The ridge voids 132 are located about the intermeshing roller 122*a* such that an upper region of each lobe 156 of each bag 154 is left un-stretched.

Figure 10:
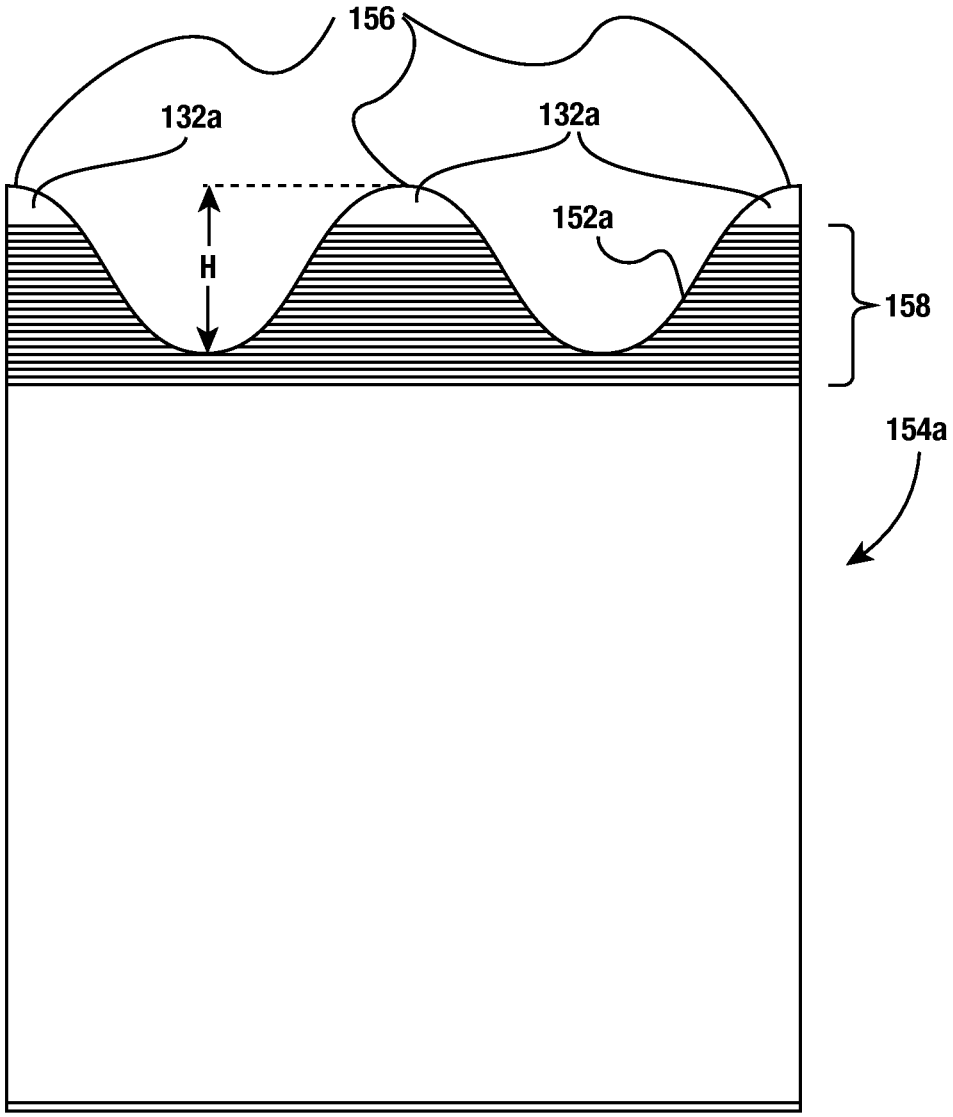
FIG. 10 depicts a front view of a trash bag of the seventh embodiment of the present invention.

FIG. 10 illustrates the structure of bag 154*a* formed by the alternate embodiment of the incremental stretching operation as illustrated by FIG. 9. As a result of the plurality of ridge voids 132, defined in an upper region of each lobe 156 is an un-stretched tip 132*a* that is devoid of any ribs that otherwise would have been formed by the incremental stretching operation. As shown in FIG. 10, a plurality of un-stretched tips 132 is defined on the bag 154. In a likewise manner, the incrementally stretched portion 158 of the bag does not extend to the upper extent of the bag top 152*a*. The remaining features of bag 154*a* remain unchanged from the embodiment illustrated in FIGS. 5 and 6. The un-stretched tips 132*a* may further improve the ease of tying the wave-cut trash bag versus the previously described embodiments.

Figure 11:
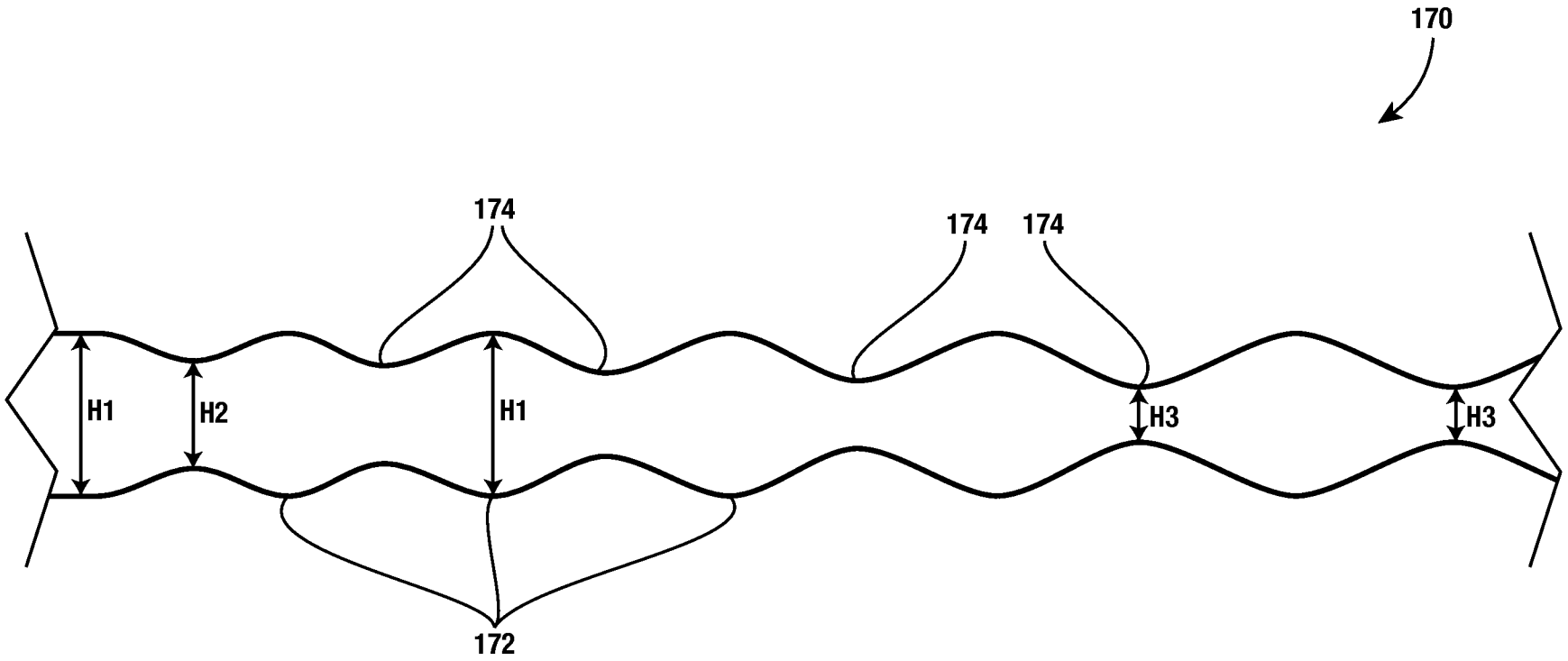
FIG. 11 depicts a side view of the gradual transition from an un-ribbed to a ribbed polymeric film due to an incremental stretching operation.

Shown in FIG. 11 is a side view of a partial length of film, with the thickness of the film exaggerated for clarity, subjected to an intermittent incremental stretching process as discussed above. Prior to entering an incremental stretching operation, such as operation 120 shown in FIG. 2*a*, the height, or thickness of the web 170, e.g. collapsed tube 110, is initially a first height H1 as shown in FIG. 11. The first height H1 is approximately equivalent to the gauge of the web. The incremental stretching operation forms thick ribs 172 and thin ribs 174 into the web 170. When the stretching operation initially engages the web 170, an initial height of the cross section of the web is a second height H2, a first transition height, since the stretching operation requires a certain amount of web length to fully engage the web 170. Multiple additional thin ribs of decreasing transition height (not shown) can be formed as the incremental stretching operation further engages the web 170. Once the stretching operation reaches a steady state operation, the height of each thin rib 174 decreases to a constant third height H3 that is maintained until the incremental stretching operation begins to disengage the web 170. The length of the web encompassing the thin ribs having heights between H1 and H3 can be defined as a first transition zone.

Although not shown in FIG. 11, when the incremental stretching operation begins to disengage the web 170, the transition reverses with a certain amount of thin ribs 174 having varying increasing heights, transitioning from the third height H3 until reaching the first height H1 once the incremental stretching operation fully disengages web 170. The length of web that encompasses the thin ribs with increasing heights between H3 and H1 can be defined as a second transition zone. This cycle of transition zones repeats when the incremental stretching operation is engaged once again for the next section of incrementally stretched film.

As previously noted, the specific embodiments depicted herein are not intended to limit the scope of the present invention. Indeed, it is contemplated that any number of different embodiments may be utilized without diverging from the spirit of the invention. Therefore, the appended claims are intended to more fully encompass the full scope of the present invention.

What is claimed is:

1. A bag formed from a collapsed tube of polymeric film, the bag comprising:

a first panel and a second panel, the first panel and the second panel joined along a first side edge, a second side edge, and a bottom edge, the first panel having a first top edge opposite the bottom edge and the second panel having a second top edge opposite the bottom edge, the first top edge and second top edge defining an opening of the bag, a distal end of both the first top edge and the second top edge having a wave-shaped profile, the wave-shaped profile defining a plurality of lobes, a first stretched region on the first panel comprising a plurality of ribs, the plurality of ribs generally parallel to each other, each one of the plurality of ribs extending from the first side edge towards the second side edge, the plurality of ribs comprising a plurality of thick and thin ribs, and a first un-stretched region devoid of ribs defined on the first panel, and a first transition zone between the first un-stretched region and the first stretched region, the first transition zone comprising a plurality of thick and thin ribs, the thin ribs having varying heights with at least one thin rib of intermediate height.

2. The bag of claim 1 further comprising:

a second un-stretched region devoid of ribs defined on the first panel, the second un-stretched region located on an opposite side of the first stretched region from the first un-stretched region.

3. The bag of claim 2 further comprising:

a second transition zone between the second un-stretched region and the first stretched region.

4. The bag of claim 3 further comprising:

the second transition zone comprising a plurality of thick and thin ribs, the thin ribs having varying heights with at least one thin rib of intermediate height.

5. The bag of claim 1 further comprising:

a distal end of both the first top edge and second top edge having a wave-shaped profile, the wave-shaped profile defining a plurality of lobes.

6. The bag of claim 5 further comprising:

the wave-shaped profile defining a profile height, the first stretched region separated from the bottom of the wave-shaped profile by at least one-half the profile height.

7. The bag of claim 1 further comprising:

the plurality of ribs resulting from incremental stretching of the polymeric film in a machine direction.

8. The bag of claim 7 further comprising:

the plurality of ribs formed from a pair of intermeshing rollers that intermittently incrementally stretch the polymeric film.

9. The bag of claim 8 further comprising:

the pair of intermeshing rollers having at least two rotational speeds, wherein the intermeshing rollers rotate faster when incrementally stretching the polymeric film than when not incrementally stretching the polymeric film.

10. A bag formed from a collapsed tube of polymeric film, the bag comprising:

a first panel and a second panel, the first panel and the second panel joined along a first side edge, a second side edge, and a bottom edge, the first panel having a first top edge opposite the bottom edge and the second panel having a second top edge opposite the bottom edge, the first top edge and second top edge defining an opening of the bag, a first stretched region comprising a plurality of ribs defined in the first panel, the plurality of ribs generally parallel to each other, each one of the plurality of ribs extending from the first side edge towards the second side edge, the plurality of ribs comprising a plurality of thick and thin ribs, a first un-stretched region devoid of ribs defined on the first panel, a first transition zone between the first un-stretched region and the first stretched region, and the first transition zone comprising a plurality of thick and thin ribs, the thin ribs having varying heights with at least one thin rib of intermediate height.

11. The bag of claim 10 further comprising:

a second un-stretched region devoid of ribs defined on the first panel, the second un-stretched region located on an opposite side of the first stretched region from the first un-stretched region.

12. The bag of claim 11 further comprising:

a second transition zone between the second un-stretched region and the first stretched region.

13. The bag of claim 12 further comprising:

the second transition zone comprising a plurality of thick and thin ribs, the thin ribs having varying heights with at least one thin rib of intermediate height.

14. The bag of claim 10 further comprising:

a distal end of both the first top edge and second top edge having a wave-shaped profile, the wave-shaped profile defining a plurality of lobes, the first un-stretched region located between the wave-shaped profile and the first stretched region, and the wave-shaped profile defining a profile height, a height of the first un-stretched region greater than the profile height.

15. The bag of claim 14 further comprising:

a height of the second un-stretched region at least one-half the profile height.

16. The bag of claim 10 further comprising:

the plurality of ribs resulting from incremental stretching of the polymeric film in a machine direction.

17. The bag of claim 16 further comprising:

the plurality of ribs formed from a pair of intermeshing rollers that intermittently incrementally stretch the polymeric film.

18. The bag of claim 17 further comprising:

the pair of intermeshing rollers having at least two rotational speeds, wherein the intermeshing rollers rotate faster when incrementally stretching the polymeric film than when not incrementally stretching the polymeric film.

19. The bag of claim 10 further comprising:

a height of the first stretched region greater than one-half a height of the bag.

20. The bag of claim 10 further comprising:

the first stretched region separated from the wave-shaped profile.

* * * * *